US008336214B2

(12) United States Patent
Kawaguchi et al.

(10) Patent No.: US 8,336,214 B2
(45) Date of Patent: Dec. 25, 2012

(54) SEWING MACHINE WITH ENGRAVING FUNCTION

(75) Inventors: Yasuhiko Kawaguchi, Nagoya (JP); Rino Nakama, Konan (JP); Tomoyasu Niizeki, Ichinomiya (JP); Noboru Mizuno, Nagoya (JP)

(73) Assignee: Brother Kogyo Kabushiki Kaisha, Nagoya-Shi, Aichi (JP)

( * ) Notice: Subject to any disclaimer, the term of this patent is extended or adjusted under 35 U.S.C. 154(b) by 56 days.

(21) Appl. No.: 13/167,872

(22) Filed: Jun. 24, 2011

(65) Prior Publication Data

US 2012/0000082 A1 Jan. 5, 2012

(30) Foreign Application Priority Data

Jul. 1, 2010 (JP) ..... 2010-150993

(51) Int. Cl.
*B43L 13/00* (2006.01)

(52) U.S. Cl. ..... 33/18.1; 112/2; 112/470.03

(58) Field of Classification Search ..... 33/18.1; 112/2, 78, 102, 102.5, 470.03, 470.05, 470.06
See application file for complete search history.

(56) References Cited

U.S. PATENT DOCUMENTS 4,444,141 A * 4/1984 Forrest ..... 33/836
5,099,775 A * 3/1992 Jimenez et al. ..... 33/773
7,958,834 B2 * 6/2011 Matsumoto et al. ..... 33/11
2009/0107373 A1 4/2009 Niizeki
2010/0236460 A1 * 9/2010 Kawaguchi et al. ..... 112/2
2010/0319597 A1 * 12/2010 Kawaguchi ..... 112/78
2012/0000081 A1 * 1/2012 Kawaguchi et al. ..... 33/18.1
2012/0000082 A1 * 1/2012 Kawaguchi et al. ..... 33/18.1

FOREIGN PATENT DOCUMENTS

JP 2009-108434 5/2009
JP 2012-011683 A 1/2012

* cited by examiner

*Primary Examiner* — Yaritza Guadalupe-McCall

(74) *Attorney, Agent, or Firm* — McCarter & English, LLP

(57) ABSTRACT

A sewing machine includes a needle bar to which an engraving needle is attached and is capable of executing an engraving process of forming an engraved pattern on a workpiece. The sewing machine further includes a heightwise position adjusting mechanism adjusting a mounting heightwise position of the engraving needle relative to the needle bar, a unit imaging the engraved marks formed on the workpiece by the engraving needle, thereby obtaining an image of each engraved mark, a detection unit extracting a region of each engraved mark from the image to detect a size of each engraved mark, a determination unit comparing the size of each engraved mark with a reference value stored, determining a mounting heightwise position of the engraving needle, and a unit informing of information for adjusting the mounting heightwise position of the engraving needle according to determination made by the determination unit.

12 Claims, 14 Drawing Sheets

SEWING MACHINE WITH ENGRAVING FUNCTION

CROSS-REFERENCE TO RELATED APPLICATIONS

This application is based upon and claims the benefit of priority from the prior Japanese Patent Application No. 2010-150993 filed on Jul. 1, 2010, the entire contents of which are incorporated herein by reference.

BACKGROUND

1. Technical Field

The present disclosure relates to a sewing machine which is provided with an engraving needle attached to a needle bar thereof and can execute an engraving work to form engraved marks by moving the engraving needle upward and downward while a workpiece is transferred in two predetermined directions by a transfer mechanism.

2. Related Art

There has conventionally been provided a multineedle embroidery sewing machine which can continuously execute embroidery sewing with the use of multicolor embroidery threads, for example. The embroidery sewing machine of this type is provided with a needle bar case which is mounted on a distal end of a sewing machine arm and has, for example, six needle bars. One of the needle bars is selectively coupled to a needle bar driving mechanism thereby to be vertically driven. The embroidery sewing machine is also provided with a transfer mechanism which transfers an embroidery frame holding a workpiece cloth. The embroidery sewing machine further includes a control device to which is supplied pattern data indicative of a needle location per stitch (an amount of movement of the workpiece cloth), color change and the like. The control device controls the needle bar driving mechanism and other driving mechanisms while controlling the transfer mechanism so that an embroidery frame holding the workpiece cloth is moved in two or X and Y directions, based on the supplied pattern data, whereby a multi-color embroidery sewing operation is executed.

The embroidery sewing machine of this type includes one provided with a boring device which makes a cut or bores a hole in the workpiece cloth. The boring device comprises a mount, a holder, a boring knife, a presser and a spring. The boring knife has a lower end formed with a blade portion. The boring device is attached to a specific one of needle bars and the operation of the embroidery sewing machine is started. As a result, eyelet embroidery is executable in which embroidery is made around a cut while the cut or the hole is being formed in the workpiece cloth.

On the other hand, a plurality of dents (embossment) or small holes has recently been formed in a sheet-like workpiece such as paper in a handicraft field, so that various types of patterns have been expressed using the dents or small holes. For example, a parchment craft has been becoming popular in which a plurality of dents or small holes is formed in thick tracing paper, which is formed into a decor. In this case, only the dents become cloudy when formed in the tracing paper. Patterns are made by utilizing the cloudy dents.

The inventors contemplated using a multineedle embroidery sewing machine as an apparatus which executes an engraving process to form the aforesaid dents or small holes by attaching an engraving needle for parchment craft, instead of the sewing needle. In this case, a holder to fixedly hold the sheet-like workpiece such as tracing paper is attached to a transfer mechanism, instead of an embroidery frame holding workpiece cloth. Based on generated engraving process data, a control device controls a needle bar to which the engraving needle is attached so that the engraving needle is moved upward and downward while the holder is moved by the transfer mechanism, whereby a predetermined engraving process is applied to the surface of the workpiece. Thus, various patterns each comprising a plurality of engraved marks or dents or small holes would be considered to be made.

A depth of engraving in the workpiece changes depending upon a mounting heightwise position of the engraving needle attached to the needle bar when the engraving process such as parchment craft or the like is executed by utilizing drive of the needle bar provided in the sewing machine. More specifically, the size of the engraved marks or dents or small holes to be formed on the workpiece changes. Accordingly, it has been sought that the mounting heightwise position of the engraving needle attached to the needle bar should be easily adjustable by the user. In this case, the size of an eyelet is changeable by adjusting the heightwise position of the boring knife relative to the holder in the conventional boring device.

The following work is considered to be done in order that the user may adjust the mounting height of the engraving needle relative to the needle bar. The user prepares a test workpiece to actually carry out a trial process, that is, an engraving process on the test workpiece. When visually observing an engraved mark, the user determines whether or not the size of the engraved mark is suitable, adjusting the mounting heightwise position of the engraving needle. In this case, the mounting heightwise position of the engraving needle is raised when the dent is excessively large. On the contrary, the mounting heightwise position of the engraving needle is lowered when the dent is excessively small. The aforementioned work is continued several times so that the mounting heightwise position of the engraving needle can finally be adjusted to a suitable position.

However, criterion for a determination as to whether or not the engraved mark has a suitable size depends upon the user's subjective view in the above-described adjusting manner. In particular, it is difficult for a user with less experience in the adjusting work to make a right determination. Furthermore, the adjusting work is troublesome since the trial process and the mounting heightwise position adjustment need to be carried out repeatedly. Additionally, the test workpieces are scrapped after having been used. Thus, since a large number of test workpieces are required, the test workpieces become useless.

SUMMARY

Therefore, an object of the disclosure is to provide a sewing machine which can execute an engraving process with the engraving needle being attached to the needle bar and can make a right determination as to the mounting heightwise position of the engraving needle without depending upon the user's subjective view and in which the adjusting work can easily be done by the user.

The present disclosure provides a sewing machine which includes a needle bar to which an engraving needle is attached and is capable of executing an engraving process of engraving a plurality of marks on a workpiece by moving the engraving needle upward and downward while the workpiece is transferred in two predetermined directions by a transfer mechanism, the sewing machine comprising a heightwise position adjusting mechanism which adjusts a mounting heightwise position of the engraving needle relative to the needle bar; an imaging unit which images the dents formed on the workpiece by the engraving needle, thereby obtaining an image of each engraved mark; a detection unit which extracts a region of each engraved mark from the image to detect a size of each engraved mark; a determination unit which compares the size of each engraved mark detected by the detection unit with a reference value stored, thereby determining a mounting heightwise position of the engraving needle; and an informing unit which informs of information for adjusting the mounting heightwise position of the engraving needle according to a determination made by the determination unit.

The disclosure also provides a sewing machine which includes a needle bar to which an engraving needle is attached and is capable of executing an engraving process of engraving a plurality of engraved marks on a workpiece by moving the engraving needle upward and downward while the workpiece is transferred in two predetermined directions by a transfer mechanism, the sewing machine comprising a heightwise position adjusting mechanism which adjusts a mounting heightwise position of the engraving needle relative to the needle bar; an imaging unit which images the engraved marks formed on the workpiece by the engraving needle, thereby obtaining an image of each engraved mark; a first determination unit which compares the engraved pattern in an image obtained by the imaging unit with a part of the image excluding the engraved marks, thereby determining a color luminance of each engraved mark; a second determination unit which compares the color luminance of each engraved mark determined by the first determination unit with a reference value stored on a storage unit, thereby determining the mounting heightwise position of the engraving needle; and an informing unit which informs of information for adjusting the mounting heightwise position of the engraving needle according to a determination made by the determination unit.

DETAILED DESCRIPTION

A first embodiment will be described with reference to FIGS. 1 to 10B. The first embodiment is directed to a multineedle embroidery sewing machine serving as a sewing machine. An engraving process is applied to a parchment craft in which a predetermined engraving pattern is formed on thick tracing paper in the embodiment. A large number of engraved marks or dents or recesses are formed on the tracing paper by an engraving needle with a spherical distal end.

Figure 1:
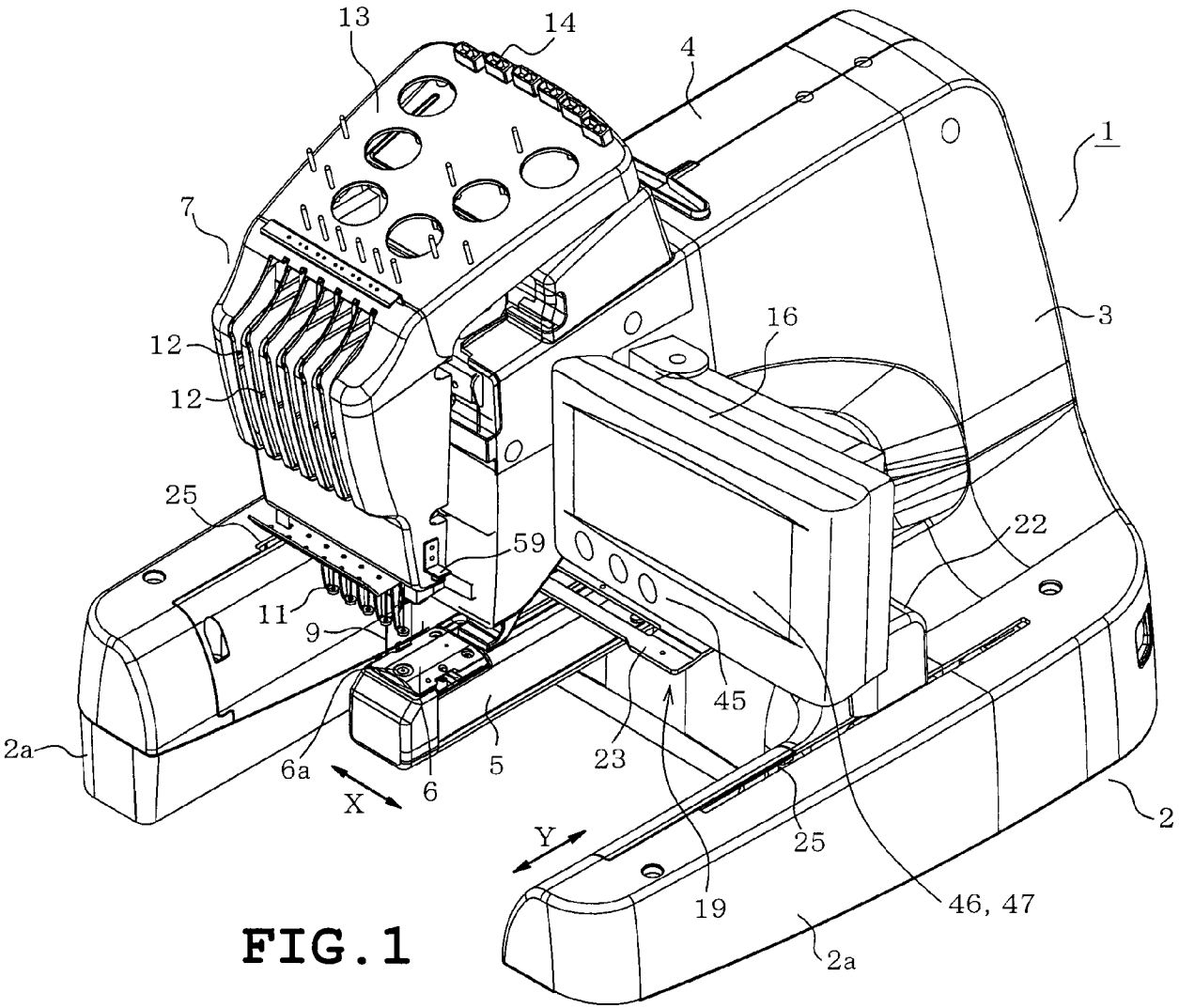
FIG. 1 is a perspective view of the multineedle embroidery sewing machine in accordance with a first embodiment.

Referring to FIG. 1, the construction of the multineedle embroidery sewing machine is schematically shown. The construction of a body 1 of the multineedle embroidery sewing machine will first be described. In the following description, the right-left direction of the sewing machine body 1 will be referred to as "X direction" and the front-back direction thereof will be referred to as "Y direction" as shown in FIGS. 1 to 3.

The sewing machine body 1 includes a support base 2 placed on a mounting base which is not shown, a pillar 3 extending upward from a rear end of the support base 2 and an arm 4 extending frontward from an upper end of the pillar 3. The support base 2 is formed substantially into a U-shape and has two legs 2*a* extending forward from right and left portions thereof respectively and an open front as viewed from above. The support base 2 further has a cylinder bed 5 which is formed integrally therewith and extends forward from the central rear thereof. A needle plate 6 having a needle hole 6*a* is detachably mounted on an upper part of the distal end of the cylinder bed 5. A thread hook and other components are provided in the cylinder bed 5 although not shown.

Figure 6:
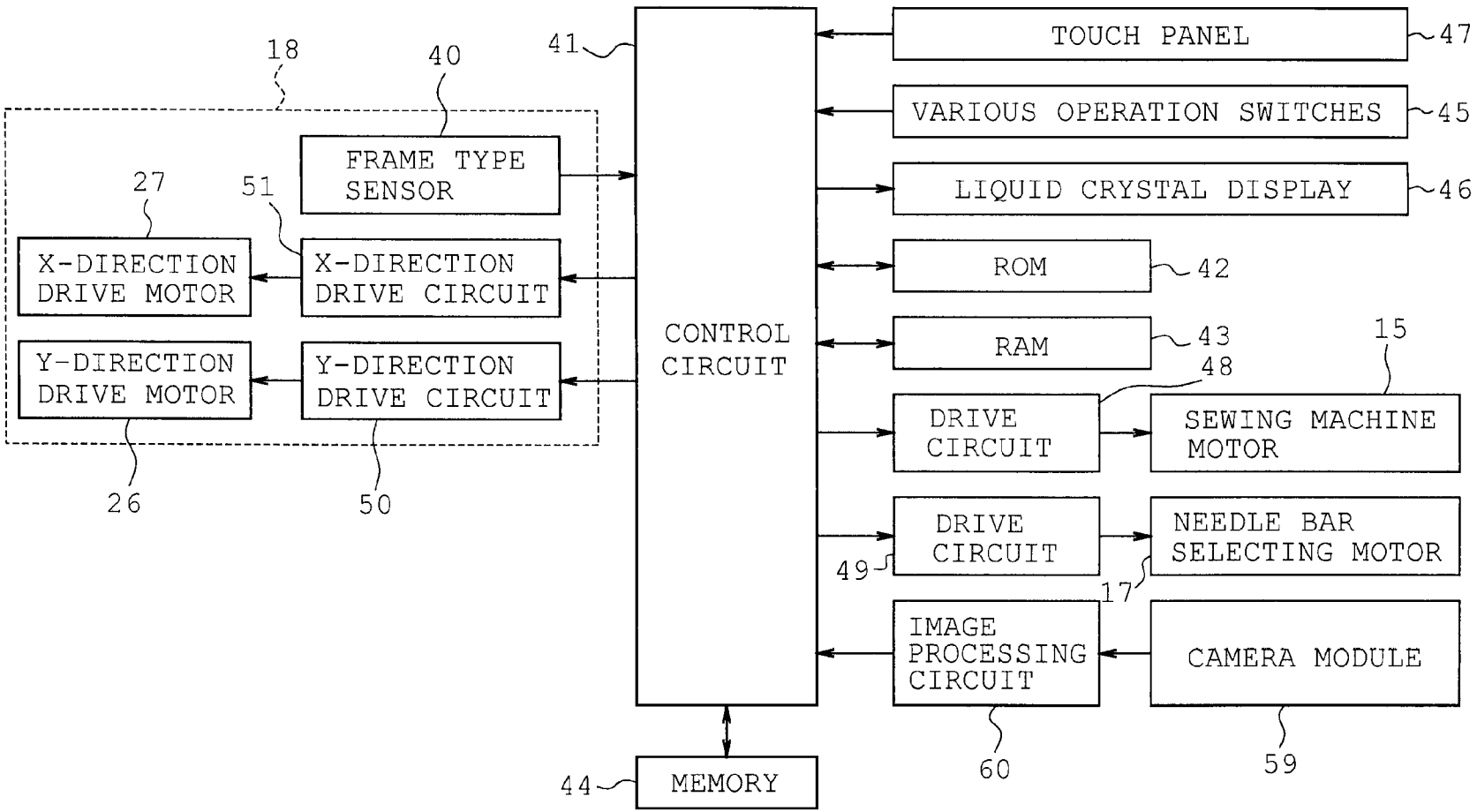
FIG. 6 is a schematic block diagram showing an electrical arrangement of the multineedle embroidery sewing machine.

An operation panel 16 is mounted on the right of the arm 4. On the operation panel 16 are provided various operation switches 45 including a sewing start key starting or stopping a sewing operation and a liquid-crystal display (LCD) 46 which displays various embroidery patterns, engraving patterns, messages for the user, and the like, as shown in FIGS. 1 and 6. A transparent touch panel 47 is mounted on a front face of the LCD 46. The touch panel 47 is configured to switch among various operation modes as will be described later. The LCD 46 is configured to display information about a mounting heightwise position of an engraving needle, thereby serving as an informing unit, as will be described later. A spool device on which, for example, six thread spools are settable is mounted on an upper rear of the arm 4 although not shown.

Figure 2:
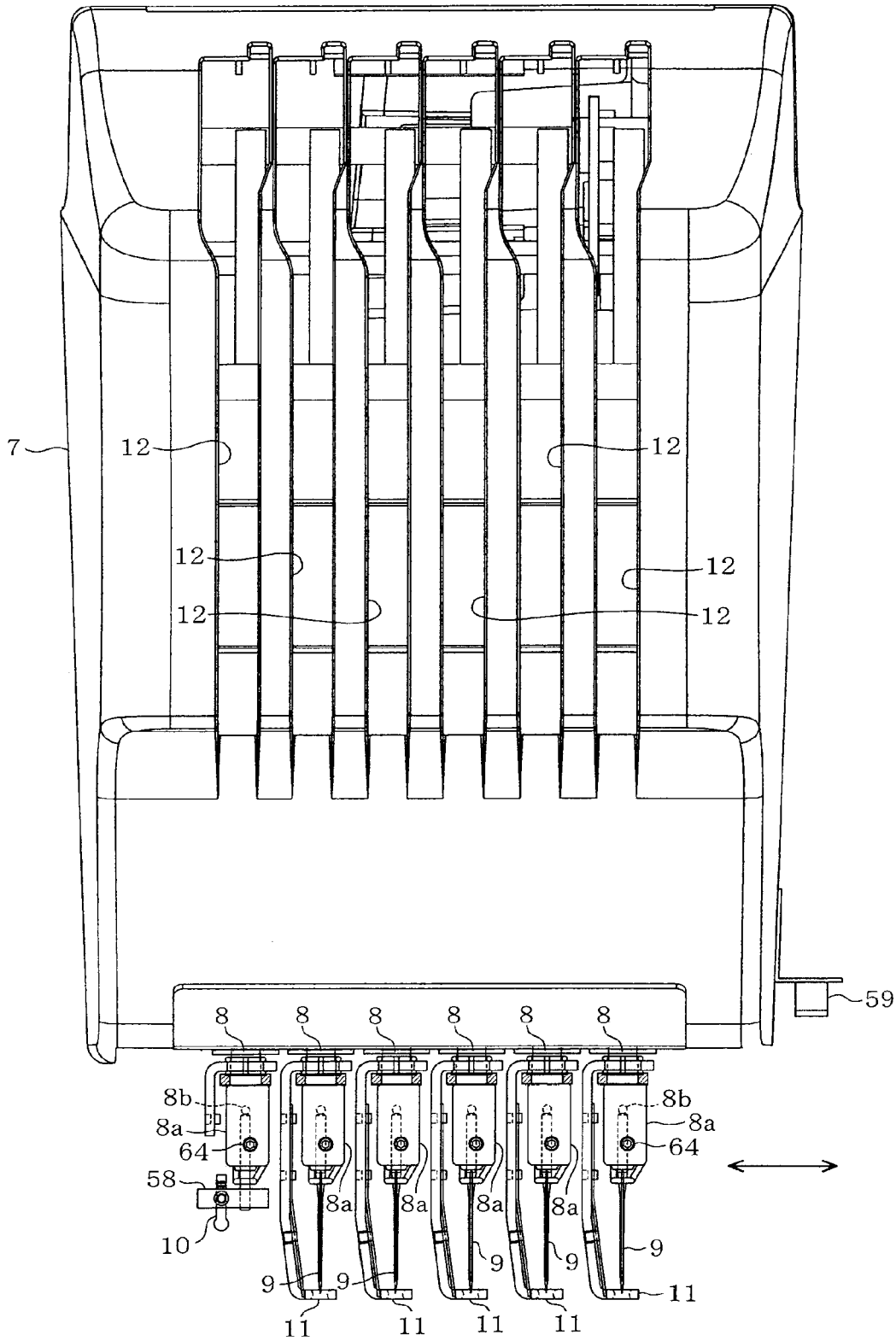
FIG. 2 is a front view of a needle bar case.
Figure 3:
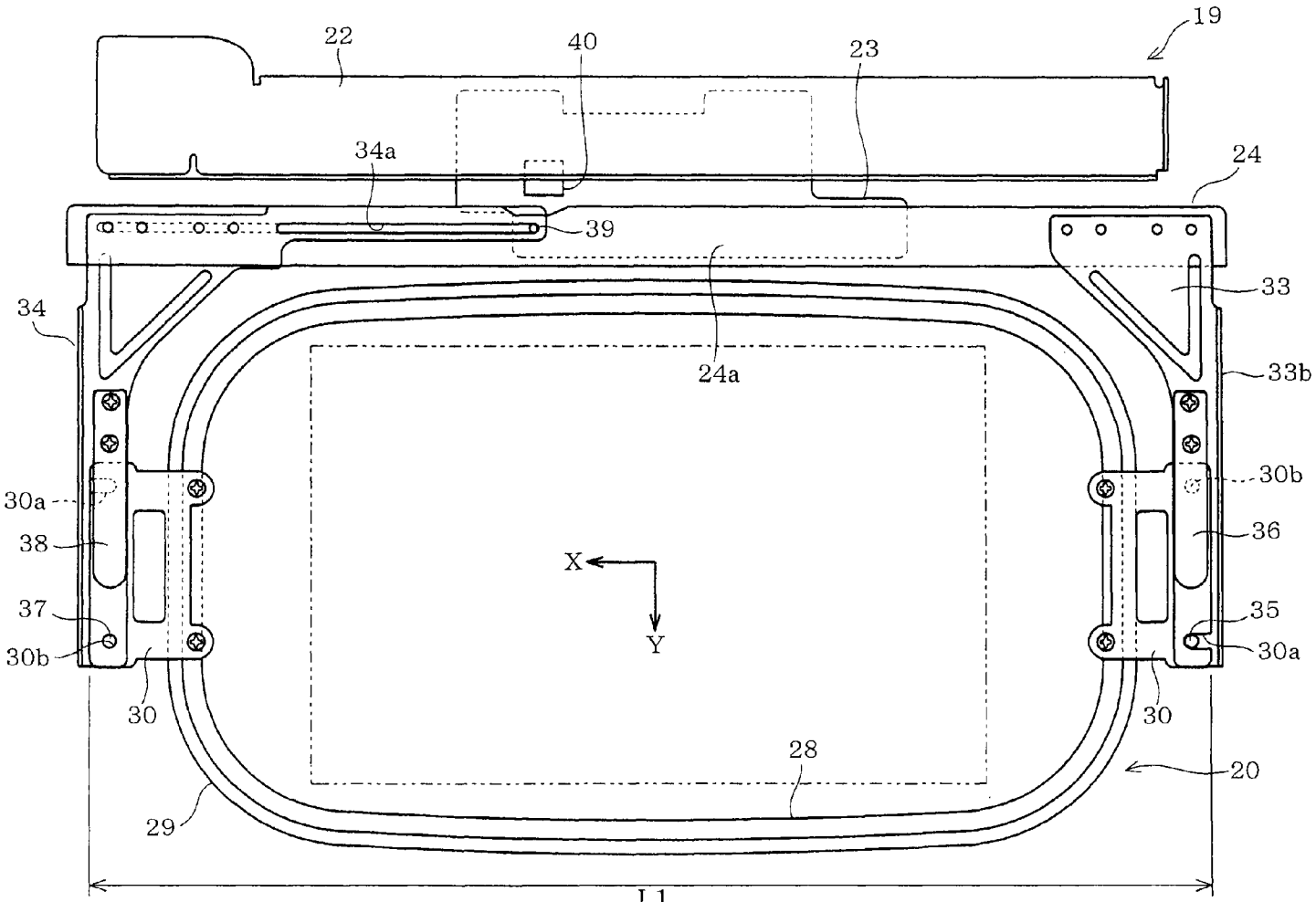
FIG. 3 is a plan view of a frame holder body attached to an embroidery frame.

A needle bar case 7 is mounted on a distal end of the arm 4 so as to be movable in the right-left direction (the X direction) as shown in FIGS. 1 and 2. The needle bar case 7 is formed into the shape of a generally rectangular box that is thin in the front-back direction as shown in FIG. 2. A plurality of, for example, six needle bars 8 which are lined up in the right-left direction are movable upward and downward. Each needle bar 8 is normally urged upward by a coil spring (not shown) thereby to be held at a needle-up position as shown in FIG. 2.

The needle bars 8 have lower ends protruding below the needle bar case 7 respectively. Needles 9 for embroidery sewing are detachably or replaceably mounted to the lower ends of the needle bars 8 respectively. Needle bar numbers "1," "2," and so on will hereinafter be used, instead of reference numeral "8" when specific one or more needle bars 8 are to be designated, and otherwise, reference numeral "8" will be used. In the embodiment, as shown in FIG. 3, an engraving needle holder 58 holding an engraving needle 10, instead of the needle 9, is detachably attached to the leftmost needle bar No. 6. The engraving needle 10 and the engraving needle holder 58 will be described later.

Presser feet 11 are mounted on lower portions of the needle bars 8 so as to be movable upward and downward in synchronization with the upward and downward movement of the needle bars 8 respectively. The presser foot 11 is detached from needle bar No. 6 since an engraving needle holder 58 is to be attached to needle bar No. 6. Furthermore, six thread take-up levers are also mounted on an upper portion of the needle bar case 7 so as to correspond to the needle bars 8 respectively although not shown in detail. The needle bar case 7 has six slits 12 which are formed in the front thereof so as to extend vertically. The thread take-up levers have distal ends which are inserted through the slits 13 to protrude to the front side, respectively. The thread take-up levers are configured to be moved upward and downward (swung) in synchronization with the upward and downward movement of the needle bars 8 respectively.

The needle bar case 7 includes an upper cover 13 which is formed integrally therewith and extends obliquely rearward from an upper end thereof as shown in FIG. 1. Six thread tensioners (only mounting holes therefor are shown) and six thread guides 14 are located on an upper end of the upper cover 13. As the result of the above-described construction, needle threads for embroidery sewing are drawn from respective thread spools set on a spool device and passed through respective thread guides 14, the thread tensioners, the thread take-up levers and the like sequentially. The needle threads are finally passed through the eyes of the needles 9 respectively, whereupon the embroidery sewing is executable. In this case, when different colors of needle threads are supplied to five needles 9 of needle bar Nos. 1 to 5, an embroidery sewing operation can continuously be carried out while the threads are automatically changed.

A camera module 59 serving as an imaging unit is mounted on a right end lower portion of the needle bar case 7 as shown in FIG. 2. The camera module 59 includes a CCD image sensor having a total number of 2 million pixels, for example. The camera module 59 is configured to image an engraved mark T of a workpiece W after execution of a test engraving operation by the engraving needle 10 in a determination mode as will be described later. Image data obtained by the camera module 59 is supplied via an image processing circuit 60 to a control circuit 41 which will be described later, as shown in FIG. 6.

Figure 5C:
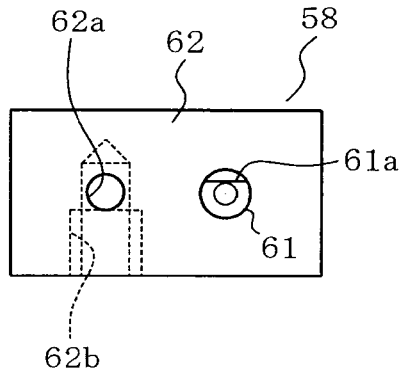
FIGS. 5A, 5B and 5C are front, left side and plan views of an engraving needle holder respectively.
Figure 5B:
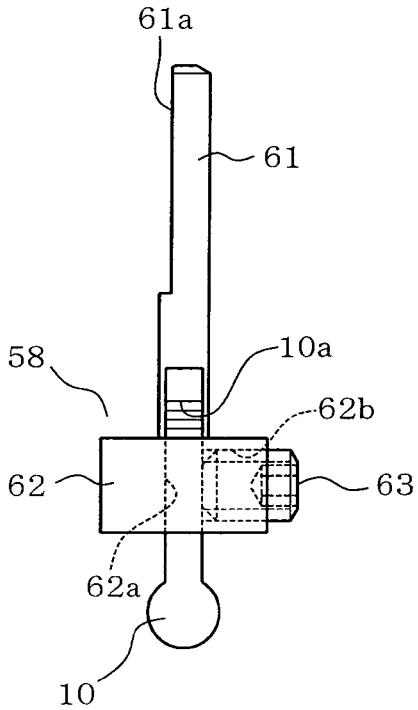
Figure 5A:
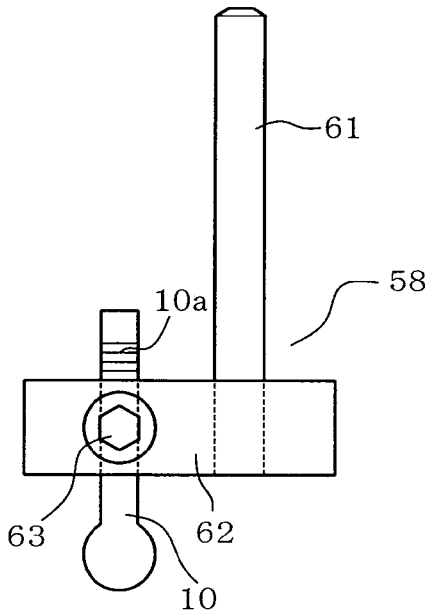

The engraving needle 10 and the engraving needle holder 58 will now be described. The engraving needle holder 58 is made of a metal and includes a vertically long round-bar shaped or cylindrical applied part 61 and a horizontally long rectangular block-shaped supporting member 62 extending leftward from a lower end of the applied part 61, as shown in FIGS. 5A to 5C. The applied part 61 and the supporting member 62 are formed integrally with the engraving needle holder 58. The applied part 61 has an upper portion having the same thickness and the same shape as an upper hilt of the needle 9. More specifically, the upper portion of the applied part 61 has a generally D-shaped portion 61*a* formed by cutting part of an outer circumferential surface thereof.

The applied part 61 is mounted to a needle clamp 8*a* provided on a lower end of each needle bar 8 while the needle 9 is detached. In this case, firstly, the applied part 61 is inserted into a hole (not shown) formed below the needle clamp 8*a*. The hole has such a D-shape that the hilt of each needle 9 is allowed to fit thereinto. The applied part 61 is inserted into the hole until an upper end thereof abuts a stopper 8*b*, thereafter being fixed by a hexagon socket setscrew 63 provided on the needle clamp 8*a*. The applied part 61 is positioned by the D-shaped portion 61*a* with respect to a rotation direction relative to the needle bar 8. The supporting member 62 is formed with an insertion hole 62*a* that is located at a left portion thereof vertically and extends therethrough. The supporting member 62 also has a screw hole 62*a* which extends therethrough from a front thereof to the insertion hole 62*a*. The hexagon socket setscrew 63 is threadingly engaged with the screw hole 62*b*.

The engraving needle 10 is made of a metal and has a distal or lower end with a spherical part to be formed into a needle shape or a round bar. The engraving needle 10 is inserted through the insertion hole 62*a* of the supporting member 62 from below so that the vertical position thereof is adjustable. The engraving needle 10 is mounted to the supporting member 62 by the setscrew 63 in the state while being positioned heightwise. An upper part of the engraving needle 10 is provided with a plurality of reference lines 10*a* (four in the embodiment) serving as indexes of the heightwise position. The reference lines 10*a* are arranged longitudinally at intervals of 0.2 mm. When viewing the reference lines 10*a* exposed above the supporting member 62 from the insertion hole 62*a*, the user can adjust the mounting heightwise position of the engraving needle 10 at the intervals of 0.2 mm. The above-described construction of the engraving needle holder 58 serves as a heightwise position adjusting mechanism.

A sewing machine motor 15 (only shown in FIG. 6) is provided in the pillar 3 although not shown in detail in the drawings. In the arm 4 are provided a main shaft (not shown) driven by the sewing machine motor 15, a needle bar driving mechanism which is driven by rotation of the main shaft 16 thereby to move the needle bars 8 and the like upward and downward, a needle bar selecting mechanism which moves the needle bar case 7 in the X direction to select one of the needle bars 8, and the like, as well known in the art. Additionally, the thread hook is also driven by rotation of the main shaft in synchronization with the upward and downward movement of each needle bar 8.

The needle bar driving mechanism includes an upward and downward moving member which is selectively engaged with a needle bar clamp (not shown) provided on each needle bar 8. The needle bar selecting mechanism is driven by a needle bar selecting motor 17 (shown only in FIG. 8) to transfer the needle bar case 7 in the X direction so that any one of the needle bars 8 located right above the needle hole 6*a* is engaged with the upward and downward moving member. Additionally, the needle bars 8 are adapted to be reciprocally moved in the upward and downward directions upon one turn of the main shaft.

The transfer mechanism 18 (see FIG. 6) includes a carriage 19 located on the upper portion of the cylinder bed 5, as shown in FIG. 1. To the carriage 19 is detachably coupled an embroidery frame 20 (see FIG. 3) holding a workpiece on which embroidery is to be sewn or a holder 21 (see FIGS. 4A and 4B) holding a workpiece W such as thick tracing paper for the engraving process as will be described later. A plurality of types of embroidery frames 20 holding the workpiece cloth and differing in the size or shape is provided as accessories although not shown in detail.

The carriage 19 includes a Y-direction carriage 22, an X-direction carriage 23 mounted on the Y-direction carriage 22 and a frame holder 24 (shown only in FIG. 3) mounted on the X-direction carriage 23 as shown in FIGS. 1 and 3. The aforesaid transfer mechanism 18 includes a Y-direction drive mechanism which is provided in the support base 2 to move the Y-direction carriage 22 in the Y direction (the front-back direction) and an X-direction drive mechanism which is provided in the Y-direction carriage 22 to move the X-direction carriage 23 and the frame holder 24 in the X-direction (right-left direction). The embroidery frame 20 or the holder 21 is held by the frame holder 24 and is transferred in two predetermined directions or the X and Y directions by the transfer mechanism 18.

The Y-direction carriage 22 is formed into the shape of a horizontally long (narrow) box and extends in the right-left direction (the X direction) so as to bridge between the right and left legs 2*a*. The legs 2*a* have upper surfaces formed with guide grooves 25 extending in the front-back direction or the Y direction, respectively, as shown in FIG. 1. The Y-direction drive mechanism includes two moving members which extend vertically through the guide grooves 25 and are provided so as to be movable in the Y direction (the front-back direction) along the guide grooves 25, respectively, although not shown in the drawings. The Y-direction carriage 22 has right and left ends connected to upper ends of the moving members respectively.

The Y-direction drive mechanism includes a linear moving mechanism comprising a Y-direction drive motor 26 (see FIG. 6) further comprising a stepping motor, a timing pulley and a timing belt. The moving members are moved by the linear moving mechanism driven by the Y-direction drive motor 26 serving as a drive source, whereby the Y-direction carriage 22 is moved in the Y direction.

The X-direction carriage 23 is formed into the shape of a horizontally long plate having a part thereof protruding forward from the lower front of the Y-direction carriage 22 as shown in FIGS. 1 and 3. The X-direction carriage 23 is supported by the Y-direction carriage 22 so as to be slidable in the X direction (the right-left direction). The X-direction drive mechanism provided in the Y-direction carriage 22 includes an X-direction drive motor 27 (see FIG. 6) comprising a stepping motor and a linear moving mechanism comprising a timing pulley and a timing belt. The X-direction drive mechanism moves the X-direction carriage 23 in the X direction (right-left direction).

The following describes the frame holder 24 mounted on the X-direction carriage 23, the embroidery frame 20 and the holder 21 latter two of which are detachably attached to the frame holder 24. Firstly, the embroidery frame 20 will be described with reference to FIG. 3. The embroidery frame 20 includes a rounded rectangular inner frame 28, an outer frame 29 detachably fitted with an outer periphery of the inner frame 28 and a pair of connecting portions 30 mounted on right and left ends of the inner frame 28 respectively. The workpiece cloth is interposed between the inner and outer frames 28 and 29 so as to be held in a stretched state inside the inner frame 28 although not shown in the drawings.

The paired connecting portions 30 have rotational symmetry through 180 degrees in a plan view. The connecting portions 30 are formed with engagement grooves 30*a* and engagement holes 30*b* for attachment to the frame holder 24 respectively. A plurality of types of embroidery frames 20 differing in the size and shape (embroidery area) from one another is prepared and selectively used according to a size of an embroidery pattern, as described above. Furthermore, the width L1 or the dimension between the outer edges of the connecting portions 30 is set so as to differ from one embroidery frame to another according to the type of the connecting portion 30. The width of the embroidery frame 20 is detected by a detection unit which will be described later, whereby the type of the embroidery frame 20 attached to the frame holder 24 is detected. FIG. 3 shows an embroidery frame 20 having a largest width L1. Additionally, detection is also executed by the aforesaid detection unit when the holder 21 is attached to the frame holder 24 as will be described later.

Figure 4A:
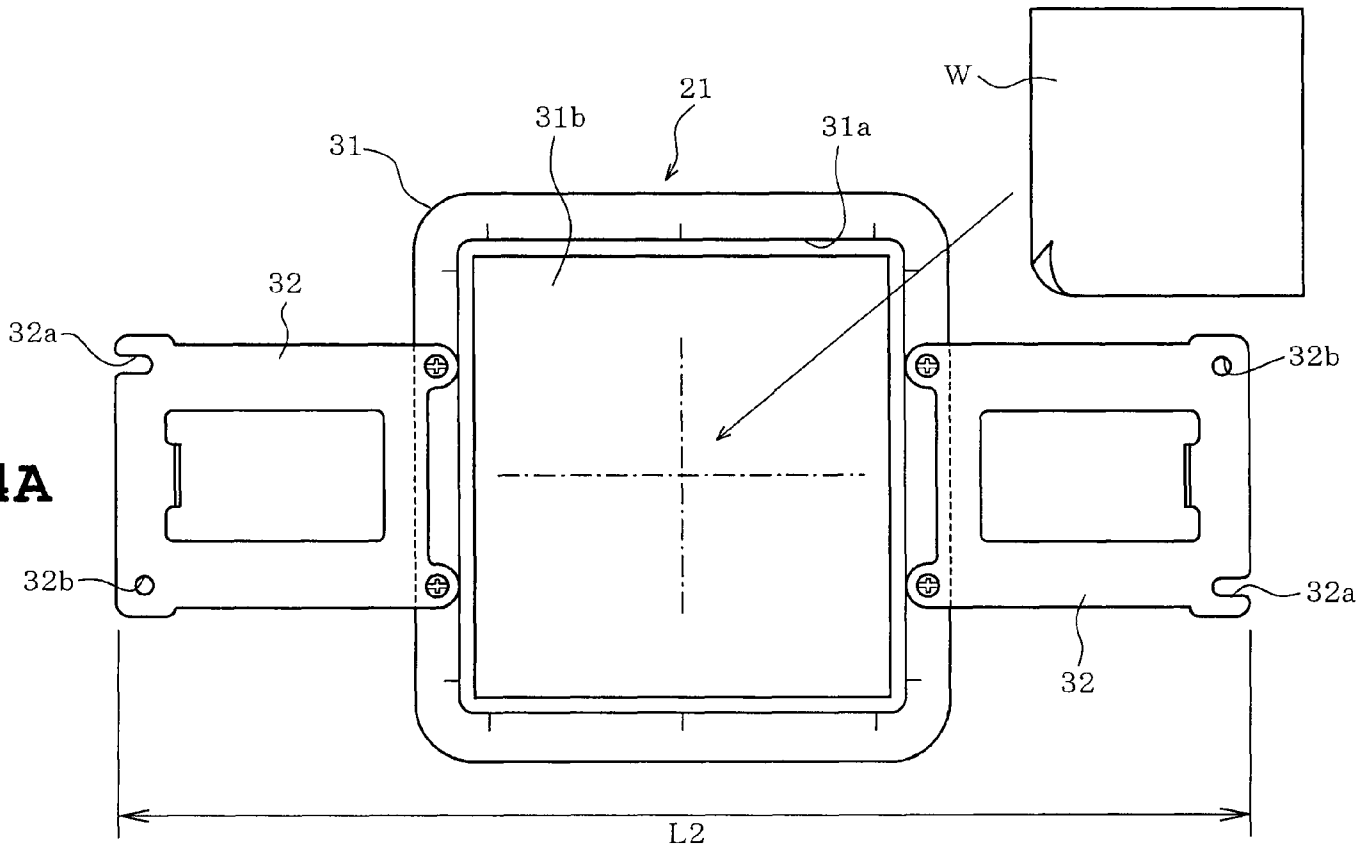
FIGS. 4A and 4B are plan and front views of a holder respectively.
Figure 4B:
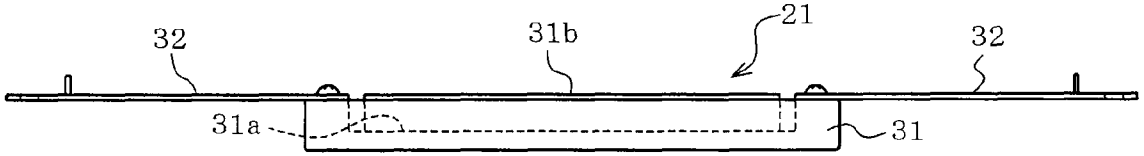

The holder 21 will now be described. The holder 21 includes a rectangular plate-shaped holding portion 31 having rounded corners and a pair of connecting members 32 attached to right and left ends of the holding portion 31 respectively, as shown in FIGS. 4A and 4B. The holding portion 31 has a bottomed holding recess 31*a* which is located at the underside of the holding portion 31 and is rectangular in shape except for a peripheral frame-shaped portion. An elastic member 31*b* is provided in the holding recess 31*a*. The elastic member 31*b* is made of a material such as a foamable resin or rubber and formed into a rectangular thin plate shape. The workpiece W such as tracing paper is previously cut into a rectangular plate-shape according to the holding recess 31*a*. The workpiece W is placed on an upper surface of the elastic member 31*b* to be fixed by a fixing unit such as a double-side adhesive tape.

The paired connecting portions 32 have rotational symmetry through 180 degrees in a plan view. Each connecting portion 32 is formed with an engagement groove 32*a* and an engagement hole 32*b* for attachment to the frame holder 24. The horizontal width L2 of the holder 21 is set so as to differ from the width L1 of each type of embroidery frame 20 as described above. Additionally, a plurality of types of holding members 21 may be provided according to the size, shape, thickness or the like of the workpiece W to be engraved.

The frame holder 24 to which the embroidery frame 20 or the holder 21 is attached or connected will be described as follows. The frame holder 24 is fixedly mounted on an upper surface of the X-direction carriage 23 as shown in FIG. 3. The frame holder 24 includes a fixedly mounted fixed arm 33 and a movable arm 34 which is mounted on the frame holder 24 so as to be displaceable relative to the frame holder 24. The position of the movable arm 34 is changed in the right-left direction by the user according to the types of the embroidery frame 20 and the holder 21, that is, the width L1 or L2.

The frame holder 24 formed into the shape of a plate extending in the X direction includes a main part 24*a* having a right end with an upper surface on which the fixed arm 33 is mounted so as to be laid on the upper surface. The fixed arm 33 has a right arm 33*b* bent substantially at a right angle and extending forward. The right arm 33*b* has an upper surface with a distal end on which an engagement pin 35 is provided, and a leaf spring 36 is mounted on the upper surface of the right arm 33*b* so as to be located in the rear of the engagement pin 35. The leaf spring 36 is provided for holding the connecting portion 30. The engagement pin 35 is engaged with the engagement groove 30*a* of the connecting portion 30 of the embroidery frame 20 or the engagement groove 32*a* of the connecting portion 32 of the holder 21.

The movable arm 34 is formed so as to be bilaterally symmetric with the right arm 33*b* and has a proximal or rear end mounted on a left upper surface of a main part 24*a* of the frame holder 24 so as to overlap the surface. The movable arm 34 has an upper surface provided with an engagement pin 37 located on a distal end thereof. The upper surface of the movable arm 34 further has a leaf spring 38 which is located in the rear of the second engagement pin 37 and provided for holding the connecting portion 30 or 32. The engagement pin 37 is engaged with an engagement hole 30*b* of the connecting portion 30 of the embroidery frame 20 or an engagement hole 32*b* of the connecting portion 32 of the holder 21.

The movable arm 34 has a proximal end formed with an elongate guide groove 34*a* which is elongate in the right-left direction. A guide pin 39 is mounted on the upper surface of the main part 24*a* of the frame holder 24. The guide pin 39 is engaged with the guide groove 34*a*. As a result, the movable arm 34 is slidable in the right-left direction relative to the main part 24*a* of the frame holder 24. Furthermore, the main part 24*a* of the frame holder 24 is provided with a positioning and fixing mechanism (not shown) which selectively fixes the movable arm 34 at one of a plurality of predetermined positions. When the user operates the positioning and fixing mechanism, the position of the movable arm 34 in the right-left direction is changeable.

As the result of the above-described construction, the user attaches the embroidery frame 20 or the holder 21 to the frame holder 24 while the movable arm 41 is fixed to a suitable position according to the type of the embroidery frame 20 or the holder 21 to be attached, that is, the width L1 or L2. Subsequently, the embroidery frame 20 or the holder 21 is attached to the frame holder 24. In attachment of the embroidery frame 20, the connecting portions 30 of the embroidery frame 20 are inserted between an upper surface of the movable arm 34 and a leaf spring 38 and between an upper surface of the fixed arm 33 and a leaf spring 36 from the front respectively as exemplified in FIG. 3. The engagement hole 30*b* of the left connecting portion 30 is then engaged with the engagement pin 37 of the movable arm 34, and the engagement groove 30*a* of the right connecting portion 30 is engaged with the engagement pin 35 of the right arm 33*b*, as viewed in FIG. 3. As a result, the embroidery frame 20 is held by the frame holder 24 and moved in the X or Y direction by the transfer mechanism 18. The holder 21 can also be attached to the frame holder 24 in a similar manner as described above.

A frame type sensor 40 is mounted on the X-direction carriage 23 for detecting the embroidery frame 20 or the holder 21 attached to the frame holder 24 based on a detected position of the movable arm 34, as shown in FIGS. 3 and 6. The frame type sensor 40 comprises a rotary potentiometer, for example, and has a detecting element which abuts a detected portion comprising an inclined surface provided on the movable arm 34, for example. The frame type sensor 40 changes a resistance value and accordingly an output voltage value according to variations in a rotational angle of the detecting element depending upon the position of the movable arm 34 with respect to the right-left direction.

An output signal generated by the frame type sensor 40 is supplied to a control circuit 41 which will be described in detail later, as shown in FIG. 6. The control circuit 41 then determines or detects the frame type between the embroidery frame 20 and the holder 21. Accordingly, the frame type sensor 40, the control circuit 41 and the like constitute a detecting mechanism which detects whether the holder 21 has been attached to the transfer mechanism 18.

In the embodiment, the sewing machine body 1 can execute a normal embroidery sewing operation with the use of a workpiece cloth and six-color embroidery threads. The sewing machine body 1 can also execute an engraving operation in which the engraving needle 10 is struck against the surface of the workpiece W such as thick tracing paper in dots while the holder 21 is transferred in the X or Y direction by the transfer mechanism 18, whereby circular dents or recesses, that is, engraved marks T are formed on the workpiece W. As the result of the engraving process, a predetermined engraved pattern, for example, an engraved flower pattern as exemplified in FIG. 7 can be formed on the workpiece W. A suitable engraved mark T is a circle with a diameter ranging from 1 mm to 2 mm, for example.

In execution of the engraving process, as shown in FIG. 2, the engraving needle holder 58 holding the engraving needle 10 is attached to needle bar No. 6 of the six needle bars 8, instead of the needle 9 as described above. The engraving needle 10 is configured to be shorter than the needle 9 and has a length that is sufficient for the engraving needle 10 to abut the surface of the workpiece W held by the holder 21 when the needle bar 8 occupies a lowermost position or lower dead point. The presser foot 11 is detached from needle bar No. 6 to which the engraving needle 10 has been attached. An embroidery sewing operation is executable using five colors of embroidery threads and needle bar Nos. 1 to 5 when the engraving needle 10 has been attached to needle bar No. 6.

Figure 9:
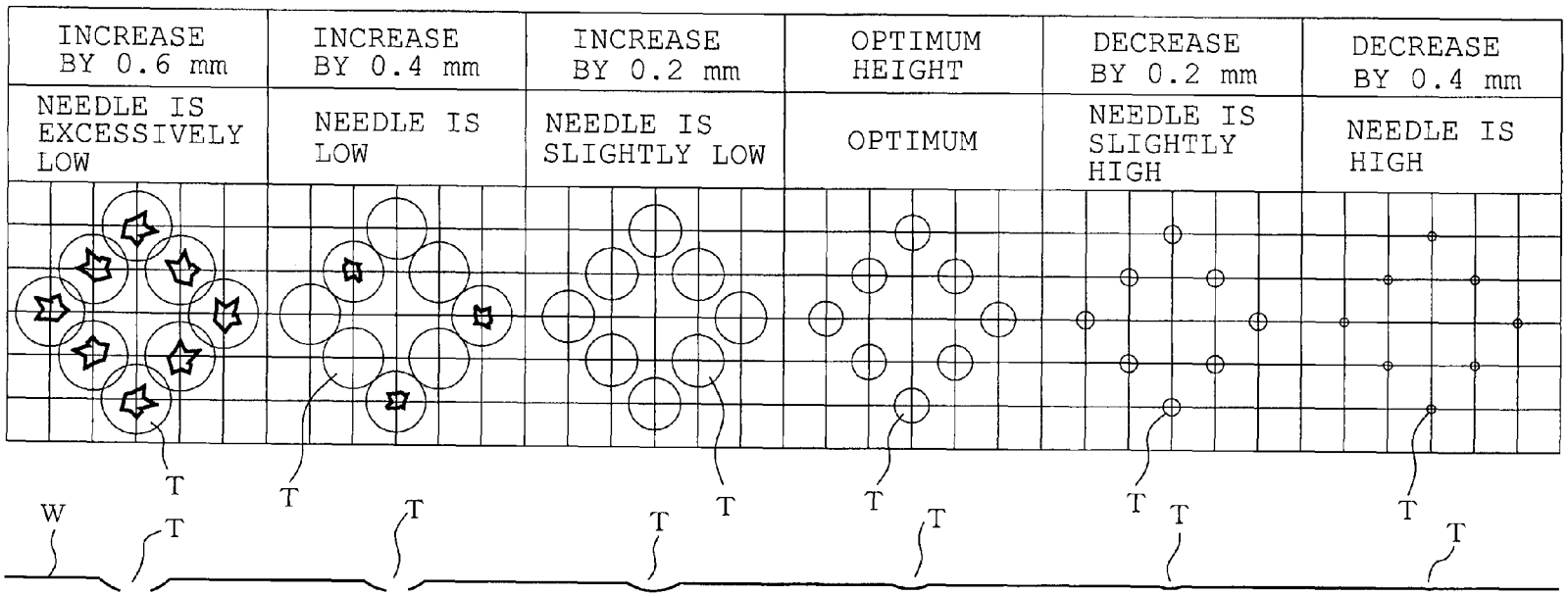
FIG. 9 shows six patterns of relationship between the size of the engraved pattern and a mounting heightwise position of the engraving needle.

The depth and accordingly the size of the engraved mark T change as shown in FIG. 9 when a mounting heightwise position of the engraving needle 10 relative to the needle bar 8 changes in execution of the engraving process on the workpiece W, which changes an engraved pattern to be formed. The size of the engraved pattern is rendered larger as the mounting heightwise position of the engraving needle 10 is low. The workpiece W such as the tracing paper would be broken when the mounting heightwise position of the engraving needle 10 is excessively low. On the other hand, the size of the engraved pattern is rendered smaller as the mounting heightwise position of the engraving needle 10 becomes high. The engraving needle 10 would not reach the workpiece W when the mounting heightwise position of the engraving needle 10 is excessively high. Accordingly, it is important to mount the engraving needle 10 to the needle bar 8 so that the engraving needle 10 occupies a suitable heightwise position. In the embodiment, the user is informed of information to adjust the mounting heightwise position of the engraving needle 10, that is, information to locate the engraving needle 10 at a suitable mounting heightwise position by execution of a height determination mode as will be described later.

FIG. 6 schematically illustrates an electrical arrangement of the multineedle embroidery sewing machine with a control circuit 41 being focused around. The control circuit 41 serves as a control unit which controls an overall operation of the multineedle embroidery sewing machine. The control circuit 41 is mainly composed of a computer or a central processing unit (CPU). A ROM 42, a RAM 43 and a memory 44 are connected to the control circuit 41. The ROM 42 stores an embroidery sewing control program, an engraving process control program, an engraving needle height determining program, various types of control data and the like. The memory 44 stores data of various types of embroidery patterns for embroidery sewing, engraving process pattern data and the like.

Operation signals generated by various operation switches 45 on the operation panel 16 and the touch panel 47 are supplied to the control circuit 41. The control circuit 41 then controls the LCD 46. In this case, while viewing contents displayed on the LCD 46, the user operates the touch panel 47 to switch the operation mode or to select a desired embroidery pattern or a desired engraved pattern by the engraving process. In this case, the operation mode includes an ordinary sewing mode, an embroidery sewing mode, an engraving process mode and a height determination mode.

A detection signal generated by the frame type sensor 40 of the transfer mechanism 18 is supplied to the control circuit 41. The control circuit 41 then controls the sewing machine motor 16 via a drive circuit 48 and also controls the needle bar selecting motor 17 via a drive circuit 49. Furthermore, the control circuit 41 controls the Y-direction drive motor 26 via a drive circuit 50 and also controls the X-direction drive motor 27 via a drive circuit 51 thereby to move the frame holder 24, that is, the embroidery frame 20 or the holder 21.

In the embroidery sewing mode, the control circuit 41 runs the embroidery sewing control program to read in embroidery data selected by the user from embroidery sewing pattern data stored on the memory 44. The control circuit 41 then controls the sewing machine motor 15, the needle bar selecting motor 17, the X-direction and Y-direction drive motors 26 and 27 of the transfer mechanism 18 and the like based on the pattern data, so that an embroidery sewing operation is automatically executed on the workpiece held by the embroidery frame 20.

In this case, the aforementioned pattern data for embroidery sewing is constituted by stitch data or transfer data indicative of a needle location per stitch (an amount of movement of the embroidery frame 20 in the X- and Y-directions), as well known in the art. The embroidery sewing pattern data additionally contains color change data indicative of change of color of embroidery thread (the needle bar 8 to be driven), thread cutting data indicative of a thread cutting operation, sewing end data and the like.

On the other hand, the control circuit 41 runs the engraving operation control program in the engraving process mode to read in the engraving process data. The control circuit 41 controls the sewing machine motor 15, the needle bar selecting motor 17, the X-direction and Y-direction drive motors 27 and 26 and the like, based on the engraving process data. The control circuit 41 automatically executes the engraving process by the engraving needle 10 on the workpiece W held by the holder 21, thereby engraving a desired pattern.

In the engraving process, needle bar No. 6 is selected, and the workpiece W is transferred to a subsequent engraving position when needle bar No. 6 or the engraving needle 10 moved upward and downward occupies an upper position, the operation being repeated. In this case, the engraving process data is mainly configured as a location of engraved point per stitch, that is, aggregation of transfer data indicative of an amount of movement of the workpiece W per stitch in the X and Y directions.

In the embodiment, the control circuit 41 executes the engraving process on the condition that the mounting of the holder 21 to the frame holder 24 has been detected by the frame type sensor 40. More specifically, in the case where the mounting of the holder 21 has not been detected, the control device 41 forbids the sewing machine motor 15 from startup even when execution of the engraving process has been instructed by the user.

When the user operates the touch panel 47, the sewing machine is switchable between an engraving process mode in which the engraving process is automatically executed and a height determination mode in which the mounting heightwise position of the engraving needle 10 is determined. Accordingly, the touch panel 47 and the control circuit 41 serve as a mode switching mechanism. When the execution of the height determination mode has been instructed, the control circuit 41 executes the engraving needle height determining process, as will be described in the operation of the sewing machine later with reference to the flowcharts. Subsequently, the control circuit 41 automatically determines and informs of as to whether or not the mounting heightwise position of the engraving needle 10 is suitable. The control circuit 41 thus serves as a determining mode execution unit.

Figure 8:
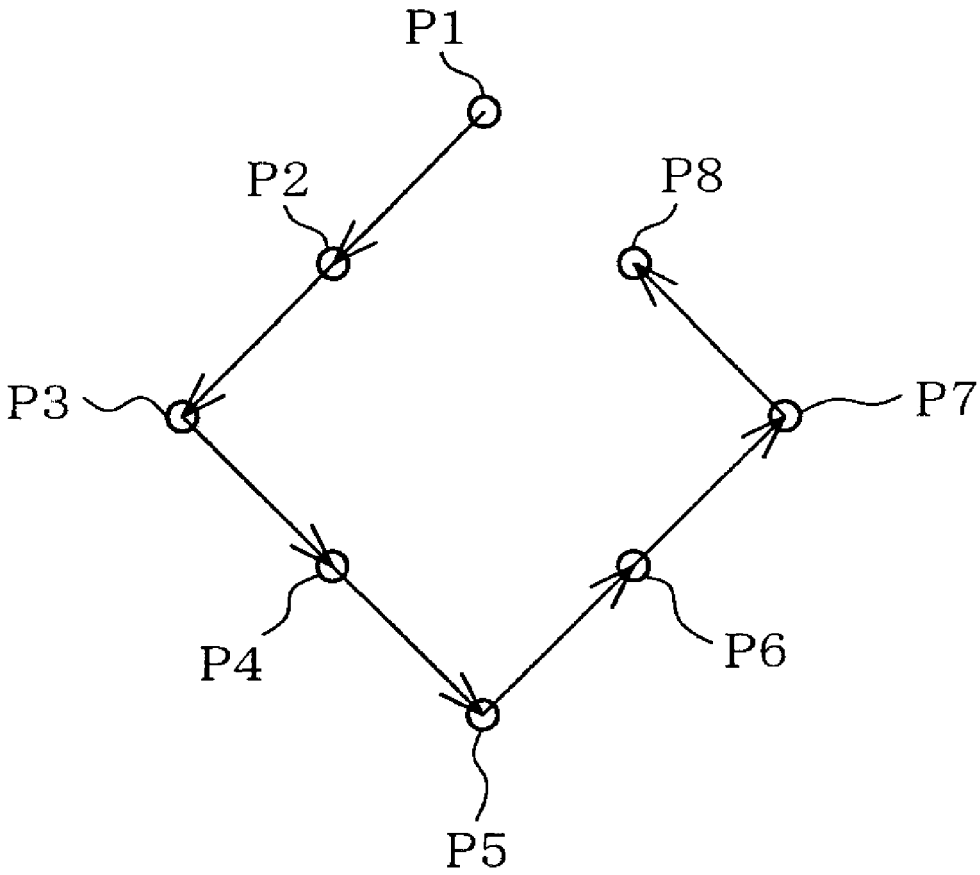
FIG. 8 shows an example of a test pattern.

In the height determination mode, the control circuit 41 firstly executes a test engraving operation by the engraving needle 10 on the workpiece W while a test workpiece is held by the holder 21. In the test engraving operation, the engraving operation is executed by the use of the engraving needle 10 at a plurality of times while the workpiece W is moved in the X and Y directions according to a previously stored test pattern. According to the test pattern, the workpiece W is engraved sequentially on the order of points P1 to P8 so that engraved marks T form a predetermined rhomboid or a square tilted by 45°, as shown in FIG. 8. However, the test pattern should not be limited to the pattern shown in FIG. 8.

The control circuit 41 then controls the holder 21 or the needle bar case 7 so that the engraved marks formed on the workpiece W by the test engraving operation are located beneath the camera module 59. The engraved marks T of the workpiece W are imaged by the camera module 59. In this case, the aforementioned test pattern is set so that all the engraved marks T fall within a screen of the camera module 59. Since the workpiece W is a sheet of tracing paper, the workpiece W is pale white and translucent. Each engraved mark T becomes cloudy when formed on the tracing paper by the engraving needle 10. More specifically, each engraved mark T becomes darker than a periphery thereof. Accordingly, each engraved mark T in an image obtained by the camera module 59 is dark white and a part including no dent T or a part around each engraved mark T is pale white. For the sake of easiness in the description, each engraved dent T is white and the part including no dent T or the part around each dent T is black. Data of an image obtained by the camera module 59 is supplied through an image processing circuit 60 into the control circuit 41.

The control circuit 41 further extracts a region of each engraved mark T from the image data to detect a size of each engraved mark T such as an area thereof. In the detection of the size (area) of each engraved mark T, it is determined whether or not each one of pixels of the image data is at a white level or a black level. The number of pixels each of which is at the white level is obtained. The detected size (area) of each engraved mark T is compared with a reference value or a threshold the data of which is previously stored on the ROM 42, whereby a mounting heightwise position of the engraving needle 10 is determined. Finally, the control circuit 41 activates the LCD 46 so that the LCD 46 displays the result of determination of the mounting heightwise position and information to adjust the mounting heightwise position of the engraving needle 10 is displayed on the LCD 46. The control circuit 41 thus serves as the aforesaid detection unit and a determination unit. LCD 46 serves as an informing unit and ROM 42 serves as a storage unit.

FIG. 9 shows the sizes of the engraved marks Tin the obtained image, the determination of the mounting heightwise position of the engraving needle 10, the information to be informed of (displayed) and a section of an engraved part of the workpiece W. As shown, the aforementioned determination of the mounting heightwise position of the engraving needle 10 is executed sequentially at six levels including "Needle is excessively low," "Needle is low," "Needle is slightly low," "Optimum," "Needle is slightly high," "Needle is high." The tracing paper as the workpiece W would break when the mounting heightwise position of the engraving needle 10 correspond to "Needle is excessively low" or "Needle is low."

An amount of adjustment to render the mounting heightwise position of the engraving needle 10 optimum is displayed on the LCD 46 as the information to adjust the mounting heightwise position of the engraving needle 10. More specifically, the LCD 46 displays messages of "Increase by 0.6 mm," "Increase by 0.4 mm," "Increase by 0.2 mm," "Optimum height," "Decrease by 0.2 mm" and "Decrease by 0.4 mm."

Figure 10A:
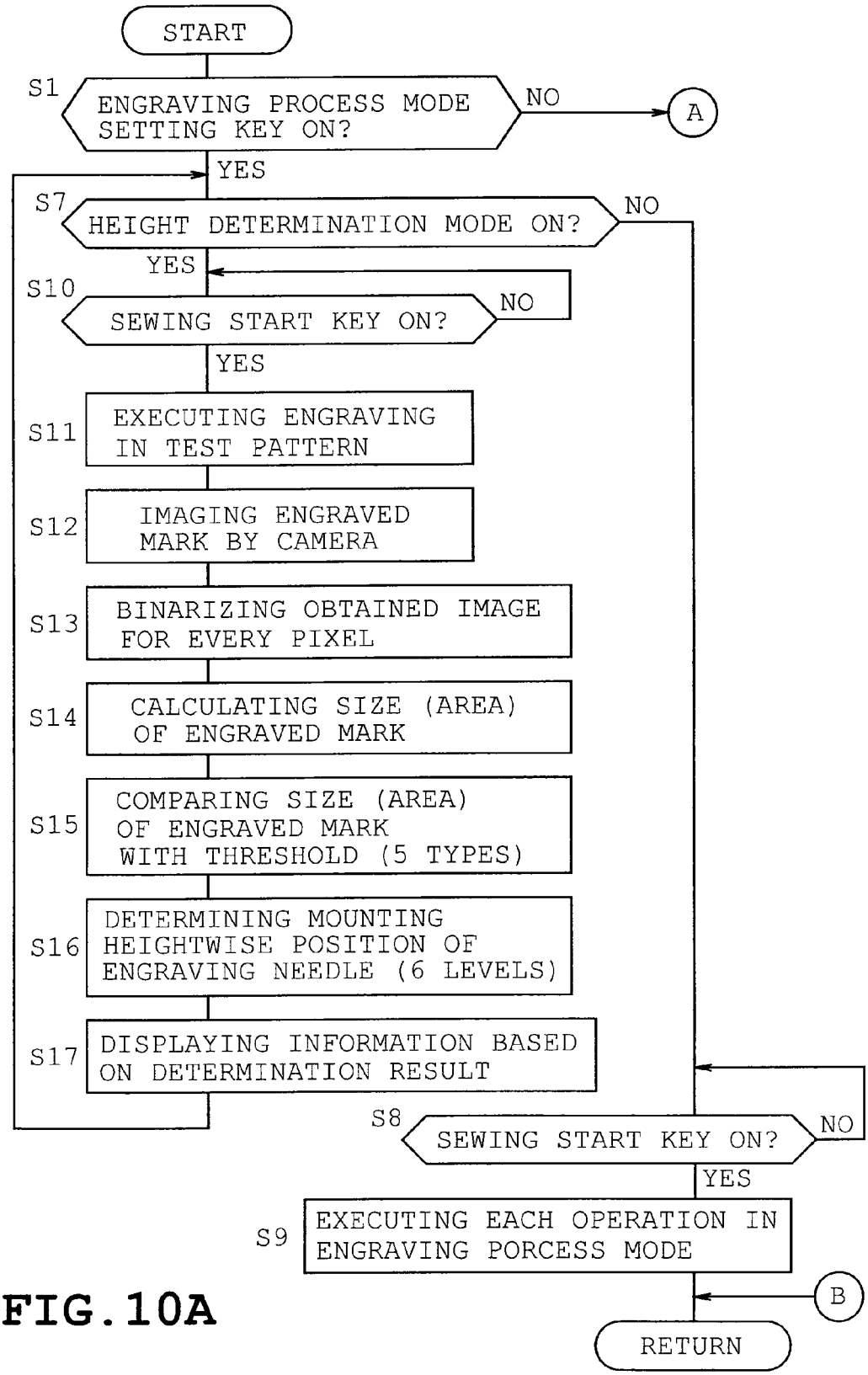
FIGS. 10A and 10B are flowcharts showing a processing procedure executed by a control circuit.
Figure 10B:
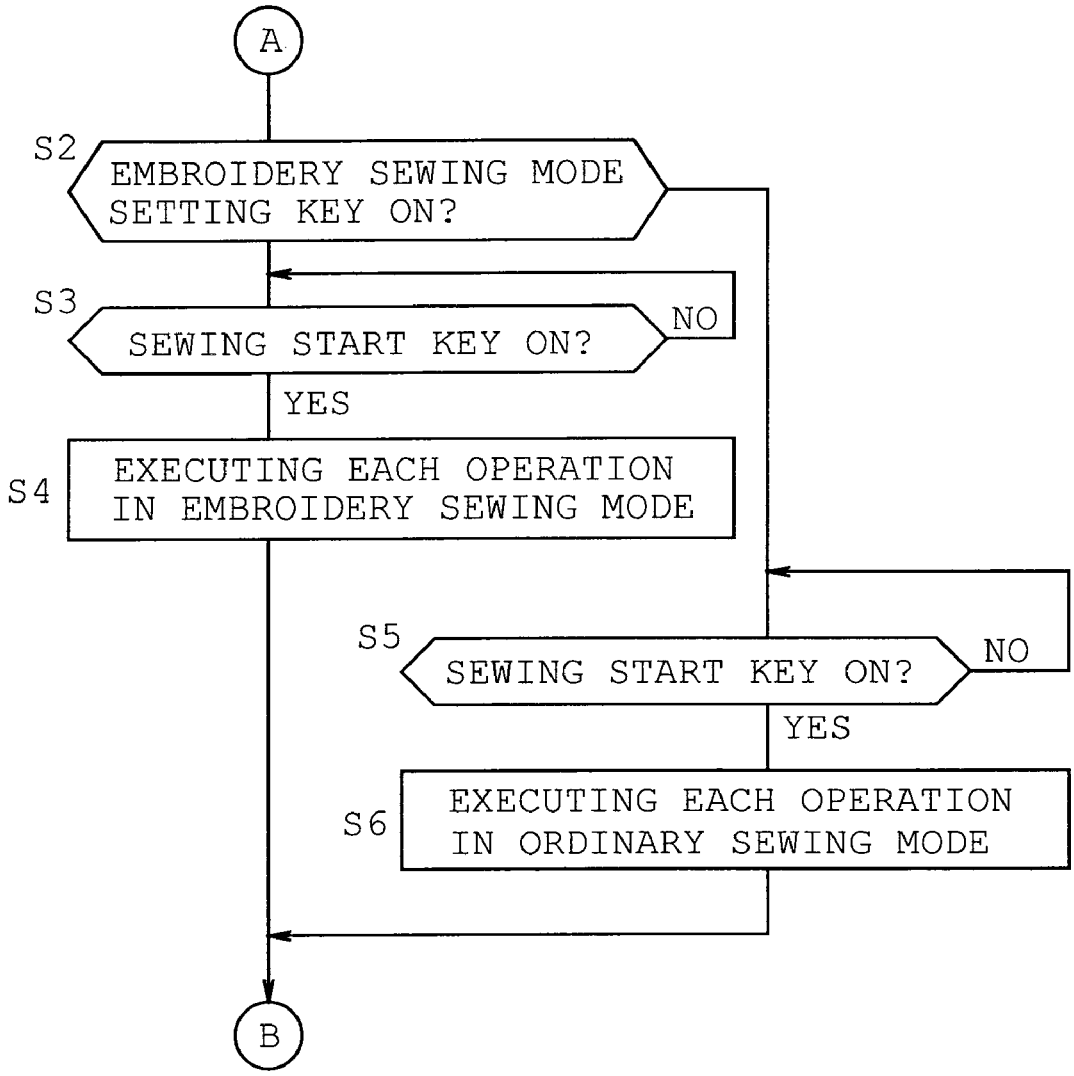

The operation of the multineedle embroidery sewing machine will be described with reference to FIGS. 10A and 10B as well as FIGS. 1 to 9. FIGS. 10A and 10B are flowcharts showing a processing procedure in each operation mode to be executed by the control circuit 41. Upon turn-on of the power supply of the sewing machine body 1 (START), the control circuit 41 determines at step S1 whether or not the engraving process mode setting key of the touch panel 47 has been operated to set the engraving process mode. When the engraving process mode has not been set (NO at step S1), the control circuit 41 proceeds to step S2 to determine whether or not the embroidery sewing mode has been set.

The user sets the embroidery sewing mode (YES at step S2) when embroidery sewing is to be executed on the workpiece. The user then attaches the embroidery frame 20 holding the workpiece cloth to the frame holder 24, selecting desirable embroidery pattern data and turning on a sewing start key of the operation switches 45 (YES at step S3). As a result, a sewing operation starts and the control circuit 41 controls the mechanisms of the sewing machine body 1 according to the selected embroidery pattern data, so that the embroidery sewing is executed on the workpiece cloth using six or five colors of embroidery threads (step S4). On the other hand, when desiring the ordinary sewing (NO at step S2), the user turns on a sewing start key of the operation switch 45 (YES at step S5). Consequently, the control circuit 41 executes the ordinary sewing (step S6).

Figure 7:
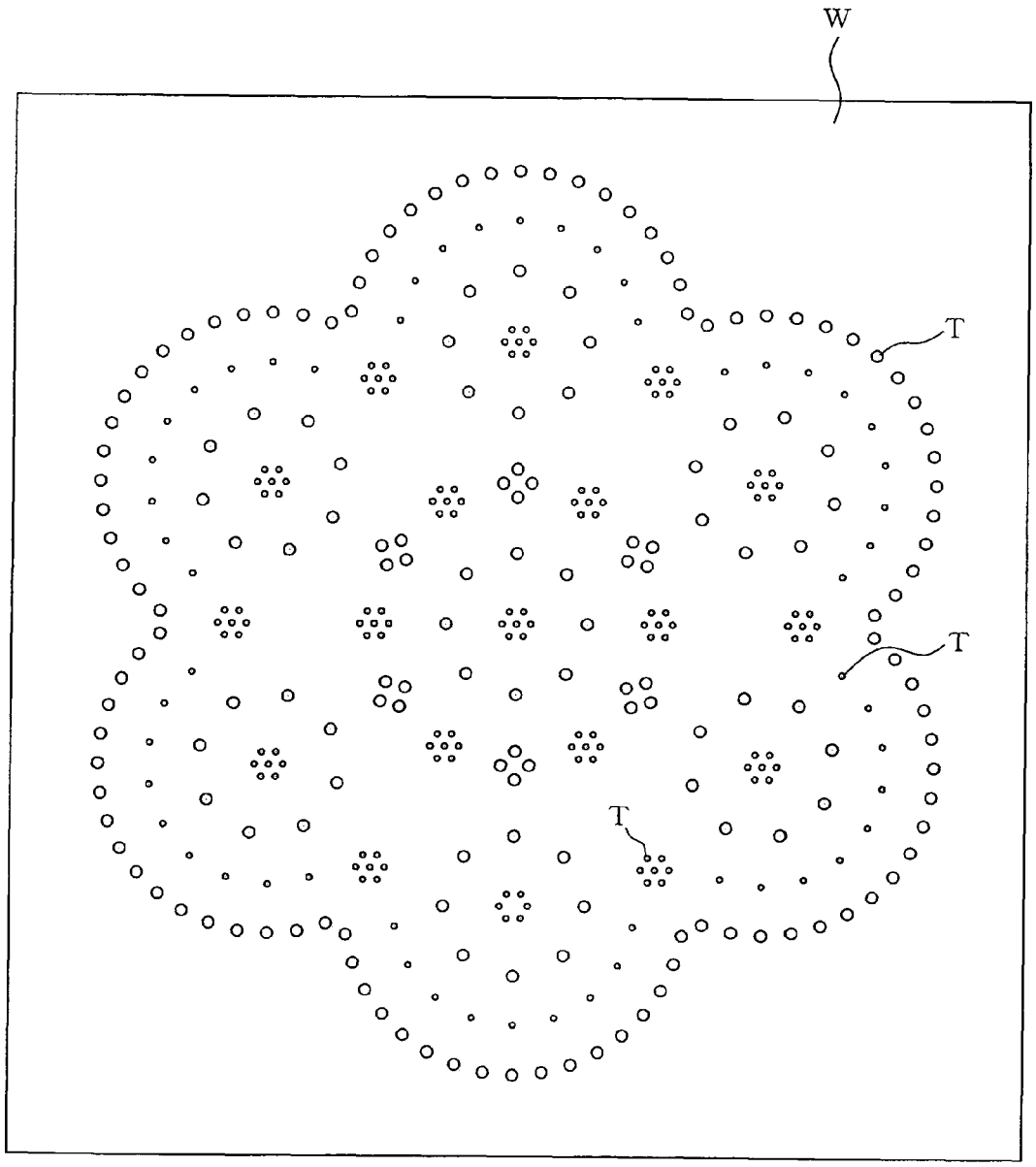
FIG. 7 is a plan view showing an engraved pattern formed on a workpiece.

On the other hand, when the user has set the engraving process mode (YES at step S1), the control circuit 41 proceeds to the next step S7 to determine whether or not the height determination mode has been set. When the height determination mode has not been set, the control circuit 41 determines that the engraving process mode has been set (NO at step S7). In the engraving process mode, the control circuit 41 executes the engraving process of forming a large number of engraved marks T on the workpiece W, based on the engraving process data. In execution of the engraving process, the user attaches the engraving needle holder 58 holding the engraving needle 10 to needle bar No. 6 and also attaches the holder 21 holding the workpiece W to the frame holder 24. The user then selects engraving data of a desired engraving pattern, starting the engraving operation (YES at step S8). The engraving process is then executed (step S9). In the engraving process, the control circuit 41 controls the transfer mechanism 18 on the basis of the engraving data to drive needle bar No. 6 while the holder 21 and accordingly the workpiece W are freely transferred in the X and Y directions. As a result, a large number of engraved marks T are formed on the workpiece W by the engraving needle 10. In this case, the engraving needle 10 is struck against predetermined positions on the workpiece W according to the engraving data, so that a predetermined engraving pattern composed of a large number of engraved marks T is formed on the workpiece W as shown in FIG. 7, for example.

There would be sometimes a case where the mounting heightwise position of the engraving needle 10 is unsuitable relative to the needle bar 8 or the engraving needle holder 58. In this case, the engraved marks T formed on the workpiece W are excessively small or excessively large. The user then sets the height determination mode before the engraving of the desired pattern so that the height determination mode is executed (YES at step S7). Consequently, the determination of the mounting heightwise position of the engraving needle 10 or the test engraving operation is automatically carried out by the control circuit 41.

The user attaches the engraving needle holder 58 holding the engraving needle 10 to needle bar No. 6 for execution of the processing in the height determination mode. With this, the user attaches the holder 21 holding a test workpiece W or test tracing paper to the frame holder 24. The sewing start key of the operation switches 45 is turned on in this state (YES at step S10). The control circuit 41 then executes a test engraving operation on the workpiece W by the engraving needle 10 (step S11). In the test engraving operation, the workpiece W is engraved sequentially on the eight points P1 to P8 according to a test pattern shown in FIG. 8, as described above.

The engraved dent T formed on the workpiece W is imaged by the camera module 59 at next step S12. In this case, all the engraved marks T fall within the imaging range or one screen of the camera module 59. When data of an image of each engraved mark T is read in, the control circuit 41 proceeds to step S13 where processing is carried out so that a contrast of each pixel is binarized into a white or black level on the basis of the obtained image data. Subsequently, the control circuit 41 proceeds to step S14 to calculate the size of each engraved mark T, that is, an area of each engraved mark T.

In this case, since each engraved mark T is white and the periphery of each engraved mark T is black, the size of each engraved mark T can be obtained by calculating an area of each pixel at the white level or the number of pixels, as described above. A diameter of each engraved mark T may be calculated, instead of the area of each engraved mark T. Furthermore, diameters of a plurality of engraved marks T may be calculated and a mean value of the diameters may be obtained. The control circuit 14 then proceeds to step S15 to compare the size of each detected dent T with a reference value the data of which is previously stored on ROM 42 or a five-level threshold. The control circuit 41 further proceeds to step S16 to determine the mounting heightwise position of the engraving needle 10.

A six-level determination is used for the mounting heightwise position of the engraving needle 10 as shown in FIG. 9. The six levels include "needle excessively low," "needle low," "needle slightly low," "optimum," "needle slightly high," "needle high." The control circuit 41 then proceeds to step S17 to inform of information to adjust the mounting heightwise position of the engraving needle 10, based on the results of the determination. More specifically, the control device 41 further controls the LCD 46 so that the LCD 46 displays six levels of messages including "Increase by 0.6 mm," "Increase by 0.4 mm," "Increase by 0.2 mm," "Most suitable height," "Decrease by 0.2 mm" and "Decrease by 0.4 mm."

Consequently, the user can adjust the engraving needle 10 to an optimum mounting heightwise position. In the adjustment of the mounting heightwise position, the user loosens the setscrew 63 of the engraving needle holder 58 while viewing the reference lines 10*a*, thereby moving the engraving needle 10 upward or downward by a predetermined amount according to the above-described instructions relative to the supporting member 62. The setscrew 63 is thereafter tightened up. Thus, the engraving needle 10 can easily be adjusted to an optimum mounting heightwise position. Accordingly, the engraving process can be executed with the engraving needle 10 occupying the optimum mounting heightwise position.

According to the foregoing embodiment, the engraving needle holder 58 holding the engraving needle 10 instead of the needle 9 is attached to the needle bar 8. Consequently, the multineedle embroidery sewing machine can be used as an apparatus which executes the engraving process of forming a large number of engraved marks T on the workpiece W thereby to produce an engraved pattern composed of the engraved marks T. Since the engraving needle holder 58 is provided with the mounting heightwise position adjusting mechanism, the engraving needle 10 can easily be adjusted to a suitable mounting heightwise position relative to the needle bar 8.

The camera module 59 is provided for imaging the engraved marks T formed on the workpiece W. The control circuit 41 detects the size of each engraved mark T based on the image obtained by the camera module 59. Consequently, the control circuit 41 can accurately determine the mounting heightwise position of the engraving needle 10 from the size of the engraved mark T. The control circuit 41 can further inform the user of the information to adjust the mounting heightwise position of the engraving needle 10 according to the result of the determination. Consequently, the user can adjust the engraving needle 10 to the suitable mounting heightwise position relative to the needle bar 8 based on the informed information.

In particular, the mode switching mechanism is provided for switching between the engraving process mode for execution of the engraving process and the height determination mode. When the height determination mode has been set, the test engraving operation is executed for the workpiece W using the engraving needle 10. Subsequently, the imaging of each engraved mark T by the camera module 59 and the detection of the size of each engraved mark T by the control circuit 41 are automatically executed. The determination of the mounting heightwise position of the engraving needle 10 by the control circuit 41 and the informing of the information on the LCD 46 are also automatically executed. As a result, when the user only instructs execution of the height determination mode, the process of determining the mounting heightwise position of the engraving needle 10 can automatically be executed. This can simplify the work of adjusting the mounting heightwise position of the engraving needle 10.

In execution of the above-described test engraving, the engraving operation is carried out by the engraving needle 10 at a plurality of times while the workpiece W is moved according to a previously stored test pattern. Accordingly, a depth of engraving and therefore the mounting heightwise position of the engraving needle can accurately be determined from a plurality of images of the engraving needle. Furthermore, since the test pattern is set so that all the engraved marks fall within the imaging range of the camera module 59, just one imaging is sufficient and accordingly, the determining process can be expedited. Moreover, since an area of the workpiece required for the test engraving is small, an amount of workpiece to be used for the test engraving can be reduced, whereupon waste can be eliminated in the test engraving operation.

Figure 11:
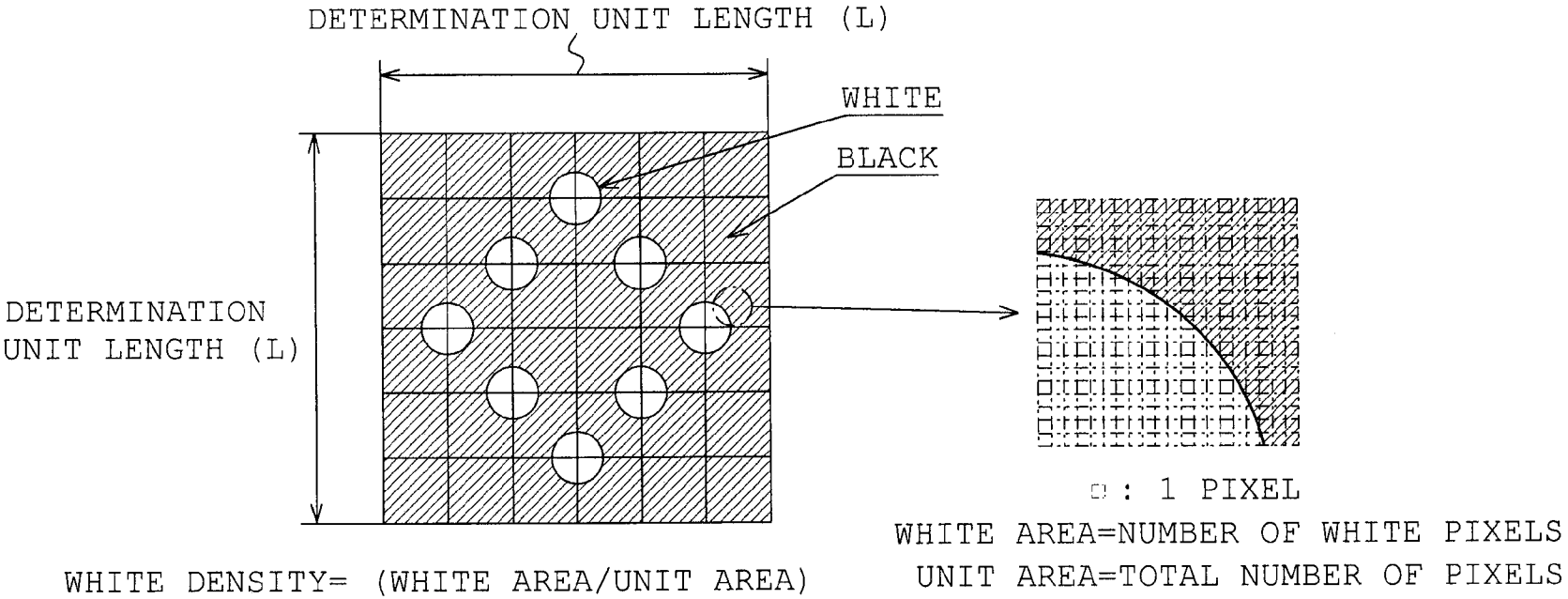
FIG. 11 is a view explaining a manner of calculating a white turbidity degree in the sewing machine of a second embodiment.
Figure 12:
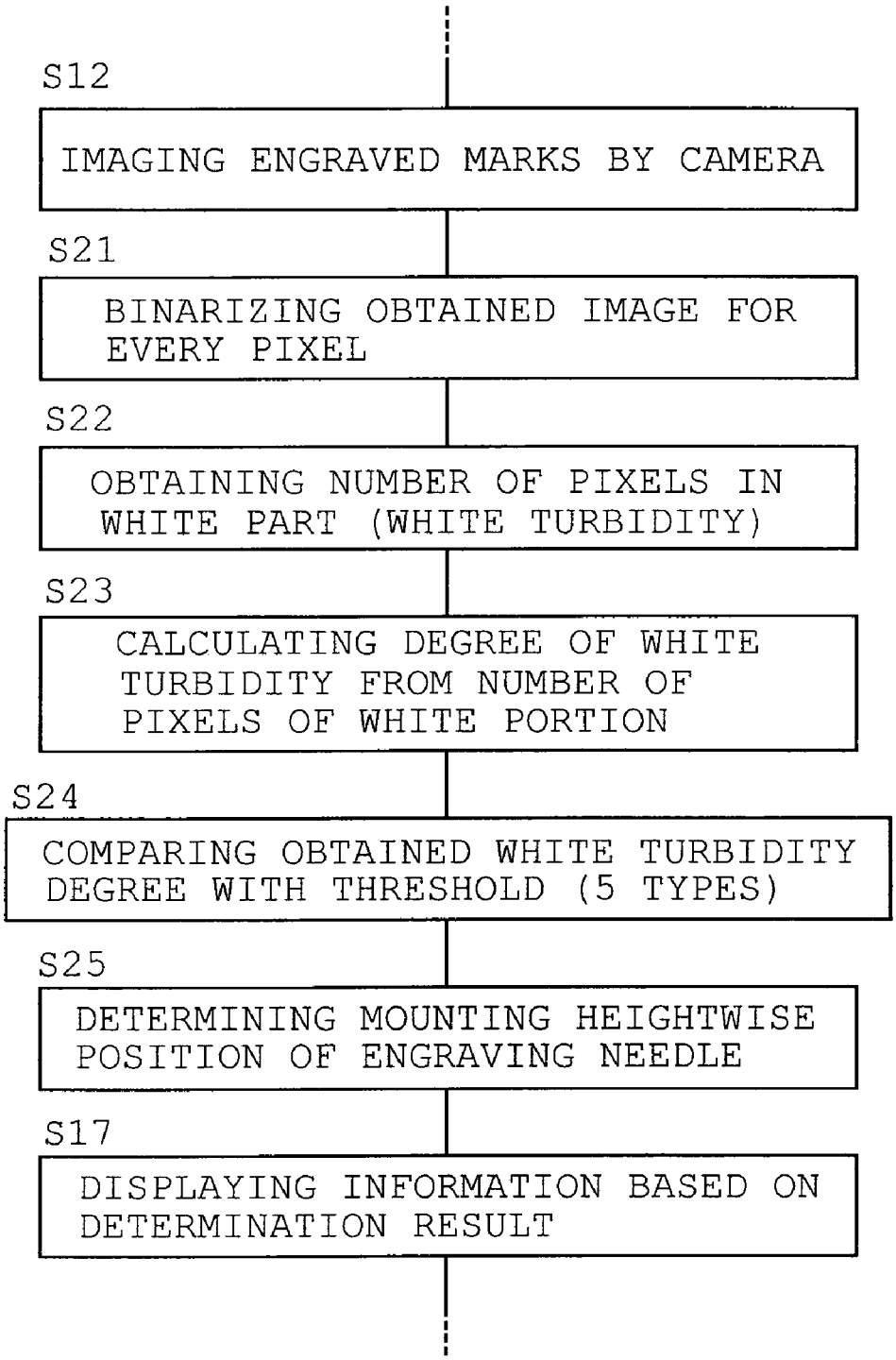
FIG. 12 is a flowchart showing part of the processing procedure executed by the control circuit.

FIGS. 11 and 12 illustrate a second embodiment. The second embodiment is also directed to the multineedle embroidery sewing machine. Since the hardware construction is common to the first and second embodiments, duplicated description and drawings will be eliminated and identical or similar parts in the second embodiment will be designated by the same reference symbols as in the first embodiment. Only the differences between the first and second embodiments will be described as follows.

In the second embodiment, too, the engraving needle 10 is also mounted so that the mounting heightwise position is adjustable while the engraving needle 10 is held by the engraving needle holder 58. On the needle bar case 7 is mounted the camera module 59 serving as the imaging unit for imaging the engraved marks T formed on the workpiece W. An image obtained by the imaging unit includes a part of each engraved mark T and another part excluding each engraved mark T. The control circuit 41 compares these two parts of the image with each other to determine the color luminance of each engraved mark T, that is, the density of the white. The control circuit 41 then compares the determined color luminance of each engraved mark T or the density of the white with the reference value or threshold the data of which is stored by the ROM 42 serving as the storage unit, so that the mounting heightwise position of the engraving needle 10 is determined on the basis of the comparison. The control circuit 41 further controls the LCD 46 so that the LCD 46 displays the result of determination about the mounting heightwise position of the engraving needle 10 and information about adjustment of the mounting heightwise position. Thus, the control circuit 41 serves as a determination unit for determining the color luminance of the engraved mark T, a determination unit for determining the mounting heightwise position of the engraving needle 10 and an informing unit for informing of the aforementioned information.

Furthermore, when the user instructs execution of the height determination mode by operation of the touch panel 47, the control circuit 41 executes the height determination process regarding the engraving needle 10, automatically determining whether or not the mounting heightwise position of the engraving needle 10 is suitable and informing of the result of the determination. In the height determination mode, the control circuit 41 controls the engraving needle 10 so that the test engraving operation is carried out for the test workpiece W according to the test pattern similar to that described above. The workpiece W is tracing paper.

The following processes (steps S21 to S25) are executed in the height determination mode in the second embodiment as shown in the flowchart of FIG. 12. The control circuit 41 activates the camera module 59 so that the engraved marks T formed on the workpiece W by the test engraving operation are imaged (step S12). The control circuit 41 then proceeds to step S21 to execute a process of binarizing the luminance value of each pixel into the white or black level based on the obtained image data. The control circuit 41 then proceeds to step S22 to obtain the number of pixels of each white portion and further proceeds to step S23 to calculate the density of the white that is indicative of the white turbidity, that is, the color luminance from the number of pixels of each white portion.

When the luminance value of each pixel has been binarized at step S21, each engraved mark is rendered white and the remaining part is rendered black, as shown in FIG. 11. The control circuit 41 then calculates a ratio of the number of white level pixels to the total number of pixels thereby to obtain the white density, that is, the white density per unit area. The total number of pixels is set in an L-by-L square region containing all the engraved marks T. The control circuit 41 thus serves as a determination unit which compares each engraved mark T with the remaining part excluding the dents, thereby determining the white color density of each engraved mark T, that is, the color luminance.

The obtained white turbidity or the white color density is compared with the reference value or a five-level threshold at step S24. The mounting heightwise position of the engraving needle 10 is determined at step S25. In this case, too, the white turbidity or the white color density is rendered larger as the heightwise position becomes low and the engraved mark T becomes large. Accordingly, the control device 41 executes the six-level determination of "needle excessively low," "needle low," "needle slightly low," "optimum," "needle slightly high," "needle high."

Subsequently, the control circuit 41 activates the LCD 46 at step S17 so that information to adjust the mounting heightwise position of each engraving needle 10 on the basis of the determination result is displayed, in the same manner as in the first embodiment. More specifically, the LCD 46 displays the control device 41 and further controls the LCD 46 so that the LCD 46 displays one of six-level messages including "Increase by 0.6 mm," "Increase by 0.4 mm," "Increase by 0.2 mm," "Most suitable height," "Decrease by 0.2 mm" and "Decrease by 0.4 mm."

In the second embodiment, too, the camera module 59 is provided which images the engraved marks T formed on the workpiece W as in the first embodiment. The control circuit 41 obtains the white color density of each engraved mark T, that is, the color luminance, based on the obtained image. Consequently, the control circuit 41 can accurately determine the mounting heightwise position of the engraving needle 10 based on the obtained color luminance. The control circuit 41 can inform the user of the information to adjust the mounting heightwise position of the engraving needle 10 according to the result of the determination. Accordingly, the user can adjust the engraving needle 10 to a suitable mounting heightwise position relative to the needle bar 8.

Furthermore, the process to determine the mounting heightwise position of the engraving needle 10 can automatically be executed when the user has instructed the height determination mode to be executed. As a result, the adjustment of the mounting heightwise position can be simplified. In this case, the engraving depth and therefore the mounting heightwise position can accurately be determined from images of a plurality of engraved marks T obtained according to the test pattern of the test engraving operation. The determination process can be expedited since the engraved marks T are imaged once. Moreover, since an area of the workpiece required for the test engraving is small, an amount of workpiece to be used for the test engraving can be reduced, whereupon waste can be eliminated in the test engraving operation.

Figure 13A:
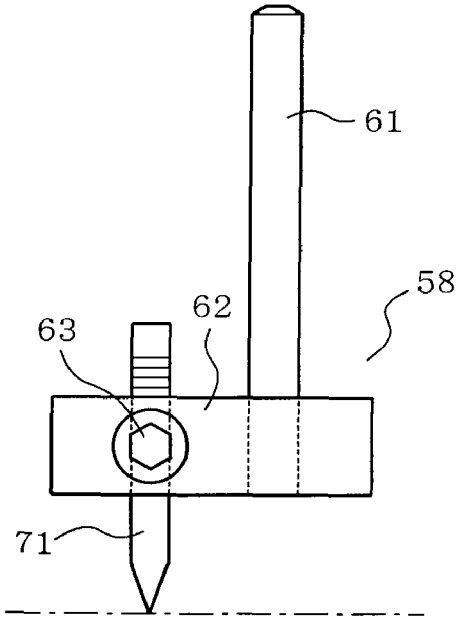
FIGS. 13A and 13B are front views of engraving needles having different distal end shapes in other embodiments respectively.
Figure 13B:
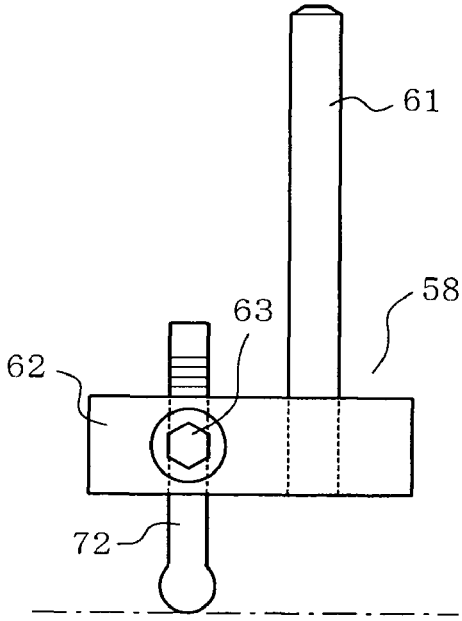

FIGS. 13A and 13B illustrate further another or third embodiment. Two types of engraving needles 71 and 72 having different shapes are shown in FIGS. 13A and 13B respectively. More specifically, the engraving needle 71 shown in FIG. 13A has a pointed distal end and can accordingly form a small hole in the workpiece W. The engraving needle 72 shown in FIG. 13B has a distal end that is formed into the shape of a sphere with a smaller diameter than the foregoing engraving needle 10. Accordingly, the engraving needle 72 can form a smaller engraved mark T on the workpiece W. The engraving needles 71 and 72 can detachably be attached to the needle bar 8 by the use of the engraving needle holder 58, and the heightwise positions of the engraving needles 71 and 72 can be adjustable relative to the needle bars 8.

The foregoing embodiments should not be restrictive but may be modified or expanded as follows. The obtained image data is binarized into a white or black level in each foregoing embodiment. However, previously colored tracing paper may be employed, and the size or color luminance of each engraved mark may be detected from colored image data, instead. The determination of the mounting heightwise position of the engraving needle 10 should not be limited to the foregoing six levels. The number of levels may be not more than 5 or not less than 7. Information about a distance from the upper surface of the elastic member 31*b* on which the workpiece W is to be placed may be used as the information to adjust the heightwise position of the engraving needle 10, instead. Furthermore, the current size or diameter of each engraved mark T may be used as the information to be displayed.

When the execution of the height determination mode has been instructed, the multineedle embroidery sewing machine is configured to automatically start the processes in the height determination mode in each foregoing embodiment. However, the multineedle embroidery sewing machine may be configured to execute the processes including the test engraving operation, the imaging by the camera module 59, the detections and determinations by the control circuit 41 on the basis of image processing and informing the user of the information, by the switching operation or manual operation by the user, instead. Furthermore, various changes may be made regarding the location of the camera module 59 and the test pattern used in the execution of the test engraving operation.

Furthermore, various changes may be made regarding the construction and electrical arrangement of the multineedle embroidery sewing machine capable of sewing embroidery. For example, the number of the needle bars 8 provided in the needlebar case 7 may be 9 or 12. The engraving operation is executable even by an embroidery machine provided with a single needle bar when a sewing needle is replaced by an engraving needle. Additionally, various changes may be made regarding the overall construction of the multineedle embroidery sewing machine, the construction of the transfer mechanism 18, the carriage 19, the holder 21 and the like.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A sewing machine which includes a needle bar to which an engraving needle is attached and is capable of executing an engraving process of engraving a plurality of marks on a workpiece by moving the engraving needle upward and downward while the workpiece is transferred in two predetermined directions by a transfer mechanism, the sewing machine comprising:

a heightwise position adjusting mechanism which adjusts a mounting heightwise position of the engraving needle relative to the needle bar;

an imaging unit which images the dents formed on the workpiece by the engraving needle, thereby obtaining an image of each engraved mark;

a detection unit which extracts a region of each engraved mark from the image to detect a size of each engraved mark;

a determination unit which compares the size of each engraved mark detected by the detection unit with a reference value stored, thereby determining a mounting heightwise position of the engraving needle; and an informing unit which informs of information for adjusting the mounting heightwise position of the engraving needle according to a determination made by the determination unit.

2. The sewing machine according to claim 1, further comprising:

a mode switching mechanism which switches between an engraving process mode for execution of an engraving process and a height determination mode for determining the mounting heightwise position of the engraving needle; and a mode executing unit which causes the engraving needle to execute a test engraving operation with respect to the workpiece when the height determination mode has been instructed by the mode switching mechanism, the mode executing unit thereafter causing the imaging unit, the detection unit, the determination unit and informing unit to automatically execute imaging the engraved dents, detection of the size of each engraved mark, determination of the mounting heightwise position of the engraving needle and informing the information respectively.

3. The sewing machine according to claim 2, wherein the test engraving operation is performed by executing an engraving operation at a plurality of times by the engraving needle while the workpiece is transferred according to a prestored test pattern, and the test pattern is set so that all the engraved marks fall within an imaging range of the imaging unit.

4. The sewing machine according to claim 3, wherein the informing unit informs of an amount of adjustment to render the mounting heightwise position of the engraving needle optimum.

5. The sewing machine according to claim 2, wherein the informing unit informs of an amount of adjustment to render the mounting heightwise position of the engraving needle optimum.

6. The sewing machine according to claim 1, wherein the informing unit informs of an amount of adjustment to render the mounting heightwise position of the engraving needle optimum.

7. A sewing machine which includes a needle bar to which an engraving needle is attached and is capable of executing an engraving process of engraving a plurality of engraved marks on a workpiece by moving the engraving needle upward and downward while the workpiece is transferred in two predetermined directions by a transfer mechanism, the sewing machine comprising:

a heightwise position adjusting mechanism which adjusts a mounting heightwise position of the engraving needle relative to the needle bar;

an imaging unit which images the engraved marks formed on the workpiece by the engraving needle, thereby obtaining an image of each engraved mark;

a first determination unit which compares the engraved pattern in an image obtained by the imaging unit with a part of the image excluding the engraved marks, thereby determining a color luminance of each engraved mark;

a second determination unit which compares the color luminance of each engraved mark determined by the first determination unit with a reference value stored on a storage unit, thereby determining the mounting heightwise position of the engraving needle; and an informing unit which informs of information for adjusting the mounting heightwise position of the engraving needle according to a determination made by the determination unit.

8. The sewing machine according to claim 7, further comprising:

a mode switching mechanism which switches between an engraving process mode for execution of an engraving process and a height determination mode for determining the mounting heightwise position of the engraving needle; and a mode executing unit which causes the engraving needle to execute a test engraving operation with respect to the workpiece when the height determination mode has been indicated by the mode switching mechanism, the mode executing unit thereafter causing the imaging unit, the detection unit, the determination unit and the informing unit to automatically execute imaging the engraved dents, detection of the size of each engraved mark, determination of the mounting heightwise position of the engraving needle and informing the information respectively.

9. The sewing machine according to claim 8, wherein the test engraving operation is performed by executing an engraving operation at a plurality of times by the engraving needle while the workpiece is transferred according to a prestored test pattern, and the test pattern is set so that all the engraved marks fall within an imaging range of the imaging unit.

10. The sewing machine according to claim 9, wherein the informing unit informs of an amount of adjustment to render the mounting heightwise position of the engraving needle optimum.

11. The sewing machine according to claim 8, wherein the informing unit informs of an amount of adjustment to render the mounting heightwise position of the engraving needle optimum.

12. The sewing machine according to claim 7, wherein the informing unit informs of an amount of adjustment to render the mounting heightwise position of the engraving needle optimum.

* * * * *